US012298086B2

(12) United States Patent
Zhong et al.

(10) Patent No.: US 12,298,086 B2
(45) Date of Patent: May 13, 2025

(54) HEAT EXCHANGER AND AIR CONDITIONING UNIT WITH MULTIPLE REFRIGERATION SYSTEMS

(71) Applicant: SANHUA (HANGZHOU) MICRO CHANNEL HEAT EXCHANGER CO., LTD., Zhejiang (CN)

(72) Inventors: Xiaoming Zhong, Zhejiang (CN); Jianlong Jiang, Zhejiang (CN); Qiang Gao, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 672 days.

(21) Appl. No.: 17/622,961

(22) PCT Filed: Jun. 28, 2020

(86) PCT No.: PCT/CN2020/098418
§ 371 (c)(1),
(2) Date: Dec. 27, 2021

(87) PCT Pub. No.: WO2020/259671
PCT Pub. Date: Dec. 30, 2020

(65) Prior Publication Data

US 2022/0243989 A1 Aug. 4, 2022

(30) Foreign Application Priority Data

Jun. 28, 2019 (CN) ..... 201910577276.9
Jun. 28, 2019 (CN) ..... 201921002572.8

(51) Int. Cl.
*F28D 1/047* (2006.01)
*F28D 7/16* (2006.01)
(Continued)

(52) U.S. Cl.
CPC ..... *F28D 7/1684* (2013.01); *F28F 1/126* (2013.01); *F28F 9/02* (2013.01)

(58) Field of Classification Search
CPC ..... F28D 7/163; F28D 7/16; F28D 1/0471; F28D 1/0435; F28D 7/1684;
(Continued)

(56) References Cited

U.S. PATENT DOCUMENTS 5,309,637 A * 5/1994 Moriarty ..... F28F 1/045 228/183
2016/0003545 A1* 1/2016 Taras ..... F28D 1/0417 29/890.052

FOREIGN PATENT DOCUMENTS

CN 103644685 A * 3/2014 ..... F28D 1/0426
CN 205717905 U 11/2016
(Continued)

OTHER PUBLICATIONS

Chinese Office Action dated Dec. 3, 2020, for corresponding CN Application No. 201910577276.9.
English translation of the Chinese Office Action dated Dec. 3, 2020, for corresponding CN Application No. 201910577276.9.
International Search Report and Written Opinion dated Sep. 17, 2020, for corresponding International Application No. PCTCN2020/098418, filed Jun. 28, 2020.
(Continued)

*Primary Examiner* — Harry E Arant
(74) *Attorney, Agent, or Firm* — David D. Brush; Westman, Champlin & Koehler, P.A.

(57) ABSTRACT

A heat exchanger and an air conditioning unit with multiple refrigeration systems. The heat exchanger includes a first header, a second header, a third header, a fourth header, a heat exchange tube including a first heat exchange tube and a second heat exchange tube alternately arranged in a length direction of the header, and fins. The first heat exchange tube or the second heat exchange tube or both has a bent section and includes a first section, a middle section, and a second section, and the heat exchanger includes a first part including the first section, a middle part, and a second part. The middle part of the heat exchanger includes the middle section and
(Continued)

the fins, and air flowing through the heat exchanger passes through the middle part and then the first part, or passes through the first part and then the middle part.

20 Claims, 8 Drawing Sheets

(51) Int. Cl.
*F28F 1/12* (2006.01)
*F28F 9/02* (2006.01)

(58) Field of Classification Search
CPC ..... F28D 1/05366; F28D 2021/0068; F28F 1/12; F28F 9/02; F28F 1/126; F25B 39/02
See application file for complete search history.

(56) References Cited

FOREIGN PATENT DOCUMENTS

| | | | | | |
|---|---|---|---|---|---|
| CN | 207407712 | U | * | 5/2018 | |
| CN | 110595111 | A | | 12/2019 | |
| CN | 210320743 | U | | 4/2020 | |
| CN | 202255037 | U | | 5/2021 | |
| EP | 1479993 | A2 | * | 11/2004 | ..... F25B 40/00 |
| JP | 2012202609 | A | | 10/2012 | |

OTHER PUBLICATIONS

English translation of the International Search Report and Written Opinion dated Sep. 17, 2020, for corresponding International Application No. PCTCN2020/098418, filed Jun. 28, 2020.

* cited by examiner

HEAT EXCHANGER AND AIR CONDITIONING UNIT WITH MULTIPLE REFRIGERATION SYSTEMS

CROSS-REFERENCE TO RELATED APPLICATIONS

This application is a Section 371 National Stage Application of International Application No. PCT/CN2020/098418, filed Jun. 28, 2020, and published as WO 2020/259671 on Dec. 30, 2020, not in English, which claims priority and rights to Chinese Patent Applications No. 201910577276.9, and No. 201921002572.8 filed on Jun. 28, 2019, which are incorporated herein by reference in their entireties.

FIELD

This application relates to the field of heat exchange technologies, and more specifically, to a heat exchanger and an air conditioning unit with multiple refrigeration systems having the heat exchanger.

BACKGROUND

An air conditioner with multiple refrigeration systems uses a plurality of separate refrigerant circuits. In order to adapt to the air conditioner with multiple refrigeration systems, a heat exchanger in the refrigerant circuit is a multi-system heat exchanger.

In the related art, the air conditioner with multiple refrigeration systems uses a plurality of separate refrigerant circuits, and a plurality of heat exchangers in the plurality of refrigerant circuits usually share a fan system and a ventilation area.

During partial load operation, there is refrigerant flow in heat exchangers in some of the refrigerant circuits of the air conditioner with multiple refrigeration systems, and there is no refrigerant flow in other heat exchangers. Because the heat exchangers with refrigerant flow share a fan system with the other heat exchangers, a part of air of the fan system passes through the other heat exchangers without refrigerant flow, which reduces heat exchange area utilization. Moreover, the plurality of heat exchangers of the air conditioner with multiple refrigeration systems have a problem of uneven outlet air temperatures, and therefore there is a need for improvement.

SUMMARY

In view of this, in one aspect of embodiments of this application, a heat exchanger is proposed. The heat exchanger is applied to an air conditioning unit with multiple refrigeration systems, which can improve heat exchange area utilization while improving evenness of outlet air temperatures.

In another aspect of embodiments of this application, an air conditioning unit with multiple refrigeration systems is further proposed.

A heat exchanger according to an embodiment of a first aspect of this application includes: a first header and a second header, where the first header and the second header are arranged in parallel; a third header and a fourth header, where the third header and the fourth header are arranged in parallel, the third header and the first header are arranged in parallel, and the fourth header and the second header are arranged in parallel; a heat exchange tube, where the heat exchange tube includes a plurality of first heat exchange tubes arranged in parallel and a plurality of second heat exchange tubes arranged in parallel, the first heat exchange tube and the second heat exchange tube are arranged in parallel, the first heat exchange tubes and the second heat exchange tubes are alternately arranged in a length direction of the first header, one end of the first heat exchange tube is connected to the first header, the other end of the first heat exchange tube is connected to the second header to connect the first header and the second header, one end of the second heat exchange tube is connected to the third header, and the other end of the second heat exchange tube is connected to the fourth header to connect the third header and the fourth header; and fins, where the fins are arranged between adjacent heat exchange tubes, and at least two of the fins are arranged between the first heat exchange tube and the second heat exchange tube that are adjacent in the length direction of the first header. At least one of the first heat exchange tube and the second heat exchange tube has a bent section and includes a first section, a middle section, and a second section, the bent section includes a first bent section and a second bent section, the first section and the middle section are connected through the first bent section, and the second section and the middle section are connected through the second bent section; and the heat exchanger includes a first part, a middle part, and a second part, the middle part of the heat exchanger includes the middle section and the fins, the first part of the heat exchanger includes the first section, and air flowing through the heat exchanger passes through the middle part of the heat exchanger and then the first part of the heat exchanger, or passes through the first part of the heat exchanger and then the middle part of the heat exchanger.

An air conditioning unit with multiple refrigeration systems according to an embodiment of a second aspect of this application includes a first refrigeration system and a second refrigeration system. The first refrigeration system and the second refrigeration system share at least one heat exchanger, the heat exchanger is the heat exchanger to any one of the foregoing embodiments, the first header and the second header are respectively connected to pipes of the first refrigeration system, and the third header and the fourth header are respectively connected to pipes of the second refrigeration system.

A heat exchanger according to an embodiment of a third aspect of this application includes: a first header and a second header, where the first header and the second header are arranged in parallel; a third header and a fourth header, where the third header and the fourth header are arranged in parallel, the third header and the first header are arranged in parallel, and the fourth header and the second header are arranged in parallel; a heat exchange tube, where the heat exchange tube includes a plurality of first heat exchange tubes arranged in parallel and a plurality of second heat exchange tubes arranged in parallel, the first heat exchange tube and the second heat exchange tube are arranged in parallel, the first heat exchange tubes and the second heat exchange tubes are alternately arranged in a length direction of the first header, one end of the first heat exchange tube is connected to the first header, the other end of the first heat exchange tube is connected to the second header to connect the first header and the second header, one end of the second heat exchange tube is connected to the third header, and the other end of the second heat exchange tube is connected to the fourth header to connect the third header and the fourth header; and fins, where the fins are arranged between adjacent heat exchange tubes, and at least two of the fins are arranged between the first heat exchange tube and the second heat exchange tube that are adjacent in the length direction of the first header. The heat exchange tube includes a first longitudinal side face and a second longitudinal side face parallel to a length direction of the heat exchange tube, and the first longitudinal side face and the second longitudinal side face are arranged opposite to each other in a thickness direction of the heat exchange tube; at least one of the first heat exchange tube and the second heat exchange tube has a bent section and includes a first section, a middle section, and a second section; the bent section includes a first bent section and a second bent section, the first section and the middle section are connected through the first bent section, and the second section and the middle section are connected through the second bent section; the first longitudinal side face of the first section and the first longitudinal side face of the middle section are arranged in parallel, and the first longitudinal side face of the second section and the first longitudinal side face of the middle section are arranged in parallel; the first longitudinal side face of the first section has a first side edge extending in a length direction of the first section, the first longitudinal side face of the middle section has a middle side edge extending in a length of the middle section, and the first longitudinal side face of the second section has a second side edge extending in a length of the second section; and an angle $\beta 1$ formed between the first side edge and the middle side edge is an acute angle, and an angle $\beta 2$ formed between the second side edge and the middle side edge is an acute angle.

The heat exchanger according to this application can be applied to an air conditioning unit with multiple refrigeration systems, which can improve heat exchange area utilization while improving evenness of outlet air temperatures. Moreover, bending positions of the first heat exchange tube and/or the second heat exchange tube are on the first longitudinal side face and the second longitudinal side face of the heat exchange tube that are arranged opposite to each other in the thickness direction, so that a stressed area is relatively large. In addition, stress of the heat exchange tube in the width direction is relatively even, which improves reliability of the heat exchange tube and the heat exchanger. In addition, areas at two end sections of the heat exchange tube are relatively reduced, which increases a finned body area of the heat exchange tube, thereby improving a heat exchange effect.

An air conditioning unit with multiple refrigeration systems according to an embodiment of a fourth aspect of this application includes multiple refrigeration systems. At least two refrigeration systems of the multiple refrigeration systems share at least one heat exchanger, and the heat exchanger is an evaporator and/or a condenser of the at least two refrigeration systems. The heat exchanger is the heat exchanger according to any one of the foregoing embodiments, and the first heat exchange tube has the bent section, the first section, the middle section, and the second section. One end of the first section of the first heat exchange tube is connected to the middle section of the first heat exchange tube through the first bent section of the first heat exchange tube, and one end of the second section of the first heat exchange tube is connected to the middle section of the first heat exchange tube through the second bent section of the first heat exchange tube. The other end of the first section of the first heat exchange tube is connected to the first header, and the other end of the second section of the first heat exchange tube is connected to the second header. The first header and the second header are respectively connected to pipes of one of the at least two refrigeration systems, and the third header and the fourth header are respectively connected to pipes of the other of the at least two refrigeration systems. The air conditioning unit with multiple refrigeration systems includes refrigerant, a flow direction of the refrigerant in the first section of the first heat exchange tube is opposite to a flow direction of the refrigerant in the middle section of the first heat exchange tube, and a flow direction of the refrigerant in the second section of the first heat exchange tube is opposite to the flow direction of the refrigerant in the middle section of the first heat exchange tube

DETAILED DESCRIPTION

Figure 1:
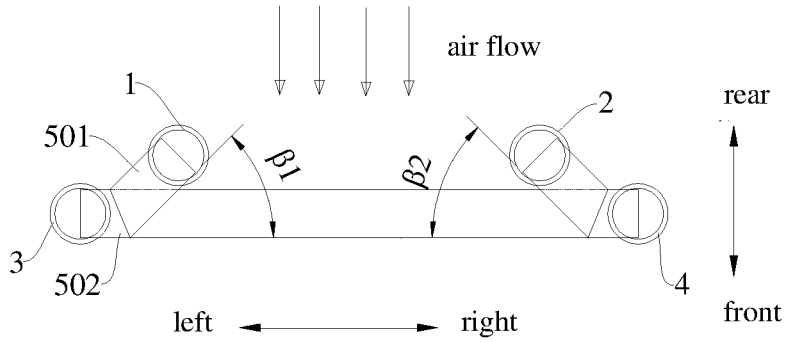
FIG. 1 is a main view of a heat exchanger according to an embodiment of this application.

Embodiments of this application are described in detail below, and examples of the embodiments are shown in the accompanying drawings. The embodiments described below with reference to the accompanying drawings are examples, and are intended to explain this application, but shall not be understood as a limitation on this application. In the description of this application, it should be understood that an orientation or positional relationship indicated by the term "center", "longitudinal", "transverse", "length", "width", "thickness", "upper", "lower", "front", "back", "left", "right", "vertical", "horizontal", "top", "bottom", "internal", "external", "clockwise", "counterclockwise", "axial direction", "radial direction", "circumferential direction", or the like is based on an orientation or positional relationship shown in the accompanying drawings, and is merely for ease of describing this application and simplifying the description, but does not indicate or imply that an apparatus or an element referred to must have a specific orientation or be constructed and operated in a specific orientation, and therefore cannot be understood as a limitation to this application.

As shown in FIG. 1 to FIG. 21, a heat exchanger 100 according to an embodiment of this application includes a first header 1, a second header 2, a third header 3, a fourth header 4, a heat exchange tube 5, and fins 6.

Figure 2:
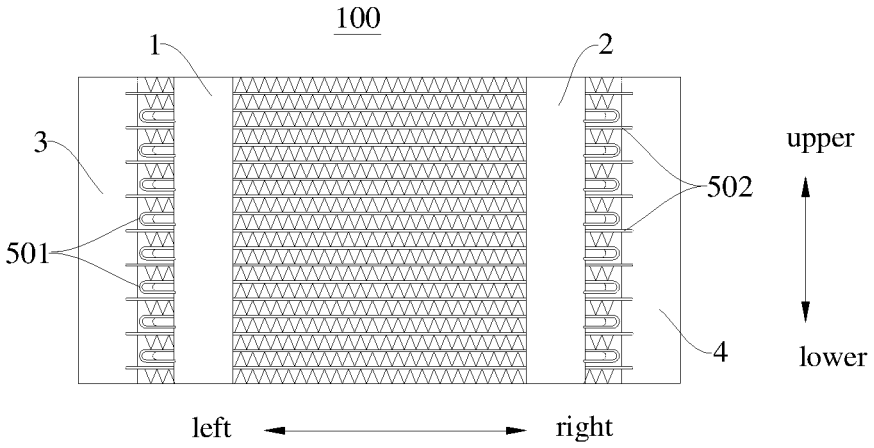
FIG. 2 is a top view of the heat exchanger in FIG. 1.

The first header 1 and the second header 2 are arranged in parallel, and the third header 3 and the fourth header 4 are arranged in parallel. In addition, the third header 3 and the first header 1 are arranged in parallel, and the fourth header 4 and the second header 2 are arranged in parallel. As shown in FIG. 2, the first header 1, the second header 2, the third header 3, and the fourth header 4 all extend in an up-down direction. As shown in FIG. 1, the first header 1 and the second header 2 are arranged to be spaced apart in a left-right direction. The third header 3 and the fourth header 4 are arranged to be spaced apart in the left-right direction.

The heat exchange tube 5 includes a plurality of first heat exchange tubes 501 and a plurality of second heat exchange tubes 502. The plurality of first heat exchange tubes 501 are arranged in parallel, and the plurality of second heat exchange tubes 502 are arranged in parallel. In addition, the first heat exchange tube 501 and the second heat exchange tube 502 are arranged in parallel. As shown in FIG. 2, the plurality of heat exchange tubes 5 are arranged to be spaced apart in the up-down direction and include the plurality of first heat exchange tubes 501 and the plurality of second heat exchange tubes 502. Each first heat exchange tube 501 and each second heat exchange tube 502 extend in the left-right direction, the plurality of first heat exchange tubes 501 are arranged to be spaced apart in the up-down direction, and the plurality of second heat exchange tubes 502 are arranged to be spaced apart in the up-down direction. The first heat exchange tube 501 and the second heat exchange tube 502 are arranged to be spaced apart in the up-down direction.

The first heat exchange tubes 501 and the second heat exchange tubes 502 are alternately arranged in a length direction of the first header 1. As shown in FIG. 2, the first heat exchange tubes 501 and the second heat exchange tubes 502 are alternately arranged in the up-down direction (a length direction of the header). It should be noted herein that "alternately arranged" should be understood in a broad sense. For example, one or more second heat exchange tubes 502 may be arranged between two adjacent first heat exchange tubes 501; one or more first heat exchange tubes 501 may be arranged between two adjacent second heat exchange tubes 502. In addition, a plurality of first heat exchange tubes 501 may be divided into a plurality of first heat exchange tube groups, with each first heat exchange tube group including at least two first heat exchange tubes 501, and a plurality of second heat exchange tubes 502 may be divided into a plurality of second heat exchange tube groups, with each second heat exchange tube group including at least two second heat exchange tubes 502; and the first heat exchange tube group and the second heat exchange tube group may be alternately arranged.

One end of the first heat exchange tube 501 is connected to the first header 1, and the other end of the first heat exchange tube 501 is connected to the second header 2 to connect the first header 1 and the second header 2. In other words, a plurality of first heat exchange tubes 501 are connected between the first header 1 and the second header 2 to connect the first header 1 and the second header 2.

One end of the second heat exchange tube 502 is connected to the third header 3, and the other end of the second heat exchange tube 502 is connected to the fourth header 4 to connect the third header 3 and the fourth header 4. In other words, a plurality of second heat exchange tubes 502 are connected between the third header 3 and the fourth header 4 to connect the third header 3 and the fourth header 4.

Fins 6 are arranged between adjacent heat exchange tubes 5, and at least two of the fins 6 are arranged between the first heat exchange tube 501 and the second heat exchange tube 502 that are adjacent in the length direction of the first header 1. Arrangement of the fins 6 can increase a heat exchange area of two adjacent heat exchange tubes 5, thereby improving heat exchange efficiency of each heat exchanger. It can be understood that the first heat exchange tube 501 and the second heat exchange tube 502 share the fins 6.

At least one of the first heat exchange tube 501 and the second heat exchange tube 502 has a bent section 54 and includes a first section 51, a middle section 52, and a second section 53, the bent section 54 includes a first bent section 541 and a second section 542, the first section 51 and the middle section 52 are connected through the first bent section 541, and the second section 53 and the middle section 52 are connected through the second bent section 542. In other words, at least one of the first heat exchange tube 501 and the second heat exchange tube 502 is bent at both sides in a length direction of the at least one of them before being bent, so as to form a bent tube.

The heat exchanger 100 includes a first part, a middle part, and a second part. The middle part of the heat exchanger 100 includes the middle section 52 and the fins 6, and the first part of the heat exchanger 100 includes the first section 51. In other words, the middle section 52 of the first heat exchange tube 501 and/or the middle section 52 of the second heat exchange tube 502 and the fins 6 are used as the middle part of the heat exchanger 100, and the first section 51 of the first heat exchange tube 501 or the first section 51 of the second heat exchange tube 502 or both are used as the first part of the heat exchanger 100.

Air flowing through the heat exchanger 100 may pass through the middle part and then the first part of the heat exchanger 100, or pass through the first part and then the middle part of the heat exchanger 100. In other words, air passing through the heat exchanger 100 first passes through the middle part of the heat exchanger 100 and then passes through the first part of the heat exchanger 100, or first passes through the first part of the heat exchanger 100 and then passes through the middle part of the heat exchanger 100.

According to the heat exchanger 100 in this embodiment of this application, the fins 6 and the middle section 52 of the first heat exchange tube 501 and/or the middle section 52 of the second heat exchange tube 502 are used as the middle part of the heat exchanger 100, the first section 51 of the first heat exchange tube 501 or the first section 51 of the second heat exchange tube 502 or both are used as the first part of the heat exchanger 100, and air flowing through the heat exchanger 100 passes through the middle part of the heat exchanger 100 and then the first part of the heat exchanger 100, or passes through the first part of the heat exchanger 100 and then the middle part of the heat exchanger 100. This can improve heat exchange area utilization while improving evenness of outlet air temperatures.

It can be understood that, according to the heat exchanger 100 in this application, the first header 1, the first heat exchange tube 501, and the second header 2 are included to form a first system, and the third header 3, the second heat exchange tube 502, and the fourth header 4 are included to form a second system. The first system and the second system can operate at the same time, that is, operate at full load, to meet a high-load operation requirement of an air conditioner. Alternatively, either of the first system and the second system can operate, that is, operate at partial load, to meet a low-load operation requirement of an air conditioner.

Therefore, the heat exchanger 100 can be applied to an air conditioning unit with multiple refrigeration systems. Moreover, the first heat exchange tubes 501 and the second heat exchange tubes 502 are alternately arranged, so that a heat exchange area of each system is roughly the same as an entire heat exchange area of the heat exchanger, that is, a heat exchange area in a partial load operation state is basically the same as a heat exchange area in a full load operation state. Therefore, a heat exchange effect energy efficiency of a multi-channel heat exchanger under partial load operation is improved while improving heat exchange area utilization. In addition, air temperatures after heat exchange are more even, avoiding local condensation. Moreover, the heat exchanger has a compact structure, thereby saving space.

In some embodiments, the second part of the heat exchanger 100 includes the second section 53. In other words, the second section 53 of the first heat exchange tube 501 or the second section 53 of the second heat exchange tube 502 or both are used as the second part of the heat exchanger 100.

Air flowing through the heat exchanger 100 passes through the middle part of the heat exchanger 100 and then the second part of the heat exchanger 100, or passes through the second part of the heat exchanger 100 and then the middle part of the heat exchanger 100, and passes through the first part of the heat exchanger 100 and the second part of the heat exchanger 100 in parallel. In other words, air flowing through the heat exchanger 100 first passes through the middle part of the heat exchanger 100 and then passes through the second part of the heat exchanger 100, or first passes through the second part of the heat exchanger 100 and then passes through the middle part of the heat exchanger 100, and the air passes through the first part and the second part of the heat exchanger 100 in parallel.

It should be noted herein that there is no overlapping part between air flow directions of the first part of the heat exchanger 100 and the second part of the heat exchanger 100, and air passes through the first part and the second part of the heat exchanger 100 in parallel instead of passes through the first part and then the second part of the heat exchanger 100 or passing through the second part and then the first part of the heat exchanger 100.

Figure 3:
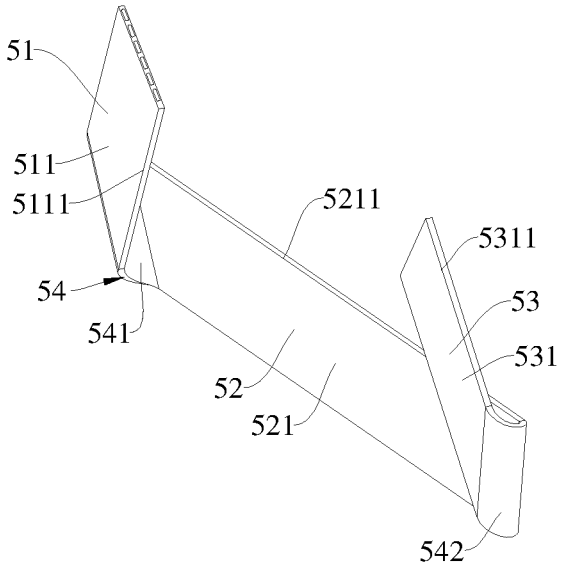
FIG. 3 is a schematic structural diagram of the heat exchange tube in FIG. 1.

In some embodiments, the heat exchange tube 5 includes a first longitudinal side face and a second longitudinal side face, where both the first longitudinal side face and the second longitudinal side face extend in a direction parallel to a length direction of the heat exchange tube 5 and are arranged opposite to each other in a thickness direction (a length direction of the header, namely, an up-down direction shown in FIG. 2) of the heat exchange tube 5. As shown in FIG. 2 and FIG. 3, the heat exchange tube 5 includes an upper side face and a lower side face that are arranged opposite to each other in the up-down direction.

It can be understood that, as shown in FIG. 3, the first section 51 includes a first side face 511 and a second side face 5 that are arranged opposite to each other in a thickness direction of the first section 51, the middle section 52 includes a first side face 521 and a second side face that are arranged opposite to each other in a thickness direction of the middle section 52, and the second section 53 includes a first side face 531 and a second side face that are arranged opposite to each other in a thickness direction of the second section 53.

The first longitudinal side face 511 of the first section 51 and the first longitudinal side face 521 of the middle section 52 are arranged in parallel, and the first longitudinal side face 531 of the second section 53 and the first longitudinal side face 521 of the middle section 52 are arranged in parallel. In other words, the first longitudinal side face 511 and the second longitudinal side face of the first section 51, the first longitudinal side face 521 and the second longitudinal side face of the middle section 52, and the first longitudinal side face 531 and the second longitudinal side face of the second section 53 are all arranged in parallel.

The first longitudinal side face 511 of the first section 51 has a first side edge 5111 extending in a length direction of the first section 51, the first longitudinal side face 521 of the middle section 52 has a middle side edge 5211 extending in a length of the middle section 52, and the first longitudinal side face 531 of the second section 53 has a second side edge 5311 extending in a length of the second section 53. An angle β1 formed between the first side edge and the middle side edge is an acute angle, and an angle β2 formed between the second side edge and the middle side edge is an acute angle.

In other words, the first heat exchange tube 501 or the second heat exchange tube 502 or both are bent tubes, and the tube before being bent has two opposite side sections in a length direction of the tube before being bent. The two opposite side sections are bent at a longitudinal side face (a side face perpendicular to a thickness direction of the tube before being bent) of the tube before being bent, and are respectively folded in a direction toward the middle section 52, so as to form the first section 51, the middle section 52, and the second section 53 on the same heat exchange tube 5, and to enable an outer end of the first section 51 to be located on one side of a width direction of the middle section 52, and an outer end of the second section 53 to be located on one side or the other of the width direction of the middle section 52.

The heat exchanger 100 according to this application is applied to an air conditioning unit with multiple refrigeration systems, and can improve air outlet evenness, and increase heat exchange area utilization. Moreover, bending positions of the first heat exchange tube 501 and/or the second heat exchange tube 502 are on the first longitudinal side face and the second longitudinal side face of the heat exchange tube 5 that are arranged opposite to each other in the thickness direction, so that a stressed area is relatively large. In addition, stress of the heat exchange tube 5 in the width direction is relatively even, which improves reliability of the heat exchange tube 5 and the heat exchanger 100. In addition, areas at two end sections of the heat exchange tube 5 are relatively reduced, which increases a finned body area of the heat exchange tube 5, thereby improving a heat exchange effect. Moreover, the first heat exchange tube 501 or the second heat exchange tube 502 or both are designed to have the foregoing structure, and when refrigerant flows through bending positions of the heat exchange tube 5, a flow direction of the refrigerant is reversed, increasing a local pressure drop. When the heat exchanger is used as an evaporator, mixing of gas-liquid two-phase refrigerant can be promoted, which facilitates even distribution of the refrigerant among the heat exchange tubes.

Further, a range of the angle β1 is $25° \leqslant \beta 1 \leqslant 85°$, and a range of the angle β2 is $25° \leqslant \beta 2 \leqslant 85°$. The angle β1 and the angle β2 are set to be within the foregoing ranges respectively, so that when refrigerant in the refrigeration system flows through the bending position of the heat exchange tube 5, the flow direction of the refrigerant is reversed, which can further increase the local pressure drop. When the heat exchanger is used as an evaporator, mixing of gas-liquid two-phase refrigerant can be promoted, which facilitates even distribution of the refrigerant among the heat exchange tubes.

In some embodiments, the first heat exchange tube 501 has a bent section 54, a first section 51, a middle section 52, and a second section 53. In other words, the first heat exchange tube 501 is a bent tube.

One end of the first section 51 of the first heat exchange tube 501 is connected to the first header 1, and the other end of the first section 51 of the first heat exchange tube 501 is connected to the first bent section 541. As shown in FIG. 2 and FIG. 3, a left end of the first section 51 of the first heat exchange tube 501 is connected to the first header 1, and a right end of the first section 51 of the first heat exchange tube 501 is connected to the first bent section 541.

The first section 51 of the first heat exchange tube 501 is formed by folding a heat exchange tube section, connected to the first header 1, of the first heat exchange tube 501 relative to the middle section 52 of the first heat exchange tube 501, and the first bent section 541 is formed at a bending position. It should be noted herein that the first bent section 541 is a circular arc transition. Therefore, at the same time when the foregoing heat exchange tube section is folded relative to the middle section 52, the circular arc transition is formed. According to the foregoing structure, a heat exchange area formed by the middle section 52 of the first heat exchange tube 501 can be increased in the case of a same ventilation area, thereby improving a heat exchange effect. In addition, the circular arc transition can reduce stress concentration on a bending position of the heat exchange tube, thereby improving reliability of the heat exchanger.

One end of the second section 53 of the first heat exchange tube 501 is connected to the second header 2, and the other end of the second section 53 of the first heat exchange tube 501 is connected to the second bent section 542. As shown in FIG. 2 and FIG. 3, a right end of the second section 53 of the first heat exchange tube 501 is connected to the second header 2, and a left end of the second section 53 of the first heat exchange tube 501 is connected to the second bent section 542.

The second section 53 of the first heat exchange tube 501 is formed by folding a heat exchange tube section, connected to the second header 2, of the first heat exchange tube 501 relative to the middle section 52 of the first heat exchange tube 501, and second bent section 542 is formed at a bending position. It should be noted herein that the second bent section 541 is a circular arc transition. Therefore, at the same time when the foregoing heat exchange tube section is folded relative to the middle section 52, the circular arc transition is formed.

In some embodiments, the first header 1 and the second header 2 are located on a same side of the middle section 52 of the first heat exchange tube 501 in the width direction (a front-rear direction shown in FIG. 1) of the middle section 52 of the first heat exchange tube 501.

In other words, the outer end of the first section 51 (an end, away from the middle section 52, of the first section 51) and the outer end of the second section 53 (an end, away from the middle section 52, of the second section 53) of the first heat exchange tube 501 are located on a same side of the width direction of the middle section 52.

As shown in FIG. 1, the outer end of the first section 51 and the outer end of the second section 53 of the first heat exchange tube 501 are both located on a rear side of the middle section 52, that is, the first header 1 and the second header 2 are both located on the rear side of the middle section 52. It can be understood that the outer end of the first section 51 and the outer end of the second section 53 of the first heat exchange tube 501 may alternatively be both located on a front side of the middle section 52, that is, the first header 1 and the second header 2 are both located on the front side of the middle section 52. Arranging the first header 1 and the second header 2 on a same side of the middle section 51 can reduce a dimension of the heat exchanger 100 in the front-rear direction, and improve structure compactness.

In some specific embodiments, the second heat exchange tube 502 has a bent section 54, a first section 51, a middle section 52, and a second section 53. In other words, a plurality of second heat exchange tube 502 are also bent tubes. The third header 3 and the fourth header 4 are located on a same side of the middle section 52 of the second heat exchange tube 502 in a width direction of the middle section 52 of the second heat exchange tube 502.

In other words, an outer end of the first section 51 (an end, away from the middle section 52, of the first section 51) and an outer end of the second section 53 (an end, away from the middle section 52, of the second section 53) of the second heat exchange tube 502 are located on a same side of the width direction of the middle section 52.

Figure 6:
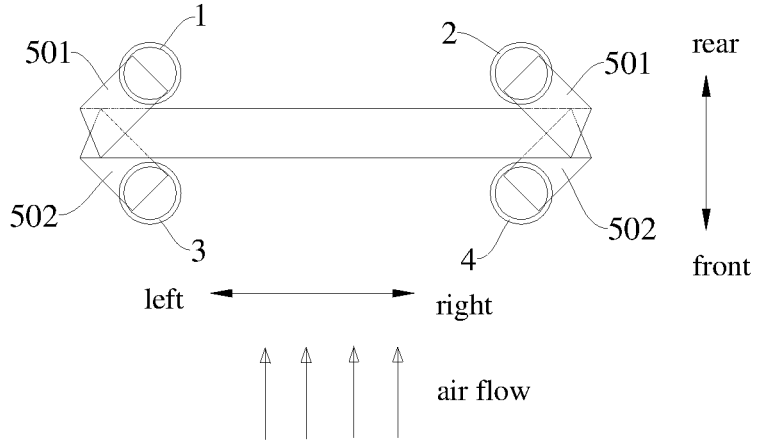
FIG. 6 is a main view of a heat exchanger according to still another embodiment of this application.

As shown in FIG. 6, the outer end of the first section 51 and the outer end of the second section 53 of the second heat exchange tube 502 are both located on a front side of the middle section 52, that is, the third header 3 and the fourth header 4 are both located on the front side of the middle section 52. It can be understood that the outer end of the first section 51 and the outer end of the second section 53 of the second heat exchange tube 502 may alternatively be both located on a rear side of the middle section 52, that is, the third header 3 and the fourth header 4 are both located on the rear side of the middle section 52.

In some specific embodiments, the first header 1, the second header 2, the third header 3, and the fourth header 4 are located on a same side of the middle section 51 of the first heat exchange tube 501 in the width direction of the middle section 52 of the first heat exchange tube 501.

Figure 11:
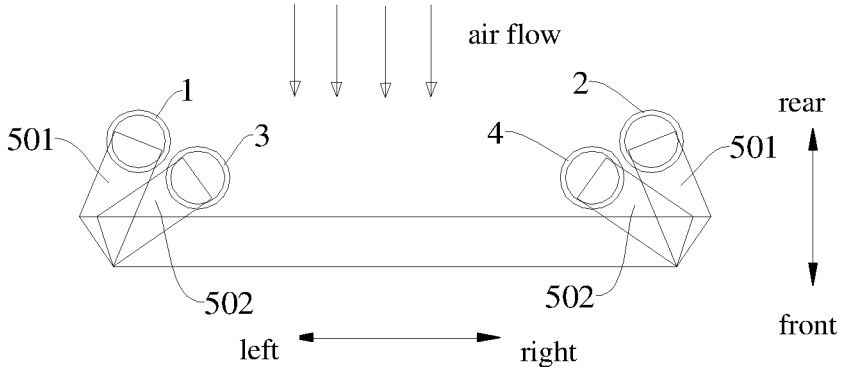
FIG. 11 is a main view of a heat exchanger according to still yet embodiment of this application.
Figure 12:
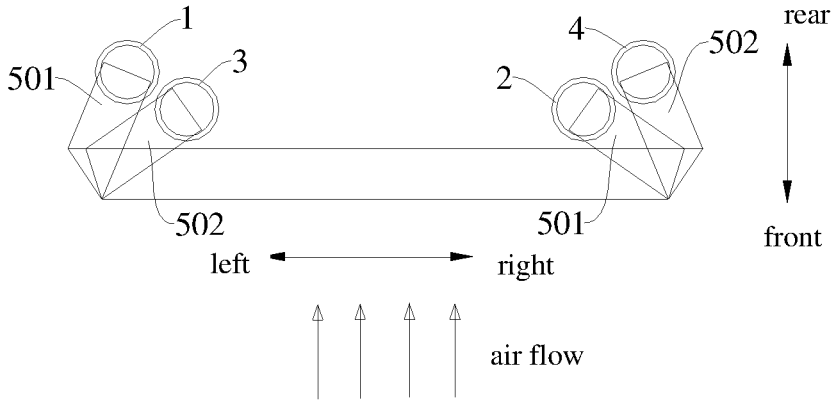
FIG. 12 is a main view of a heat exchanger according to a further embodiment of this application.
Figure 13:
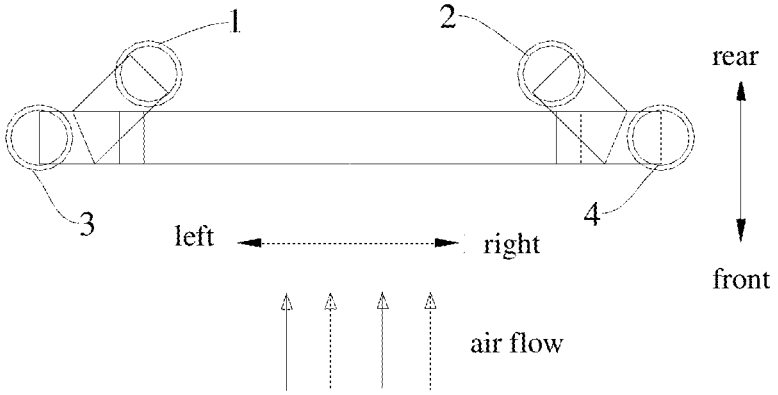
FIG. 13 is a main view of a heat exchanger according to a still further embodiment of this application.
Figure 14:
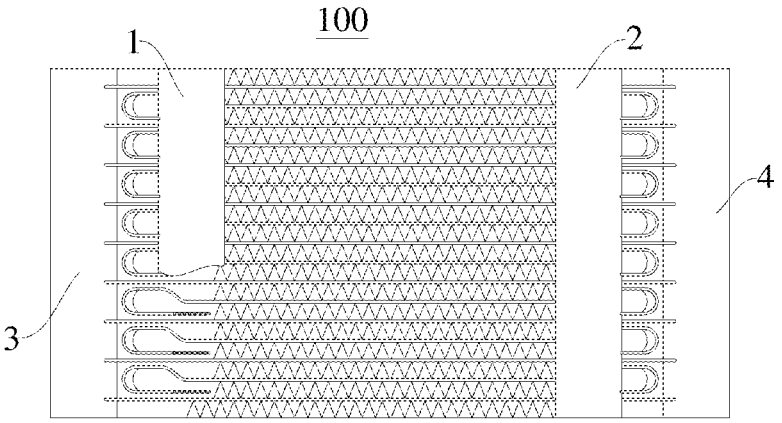
FIG. 14 is a top view of the heat exchanger in FIG. 13.

As shown in FIG. 11 and FIG. 12, the outer end of the first section 51 and the outer end of the second section 53 of the first heat exchange tube 501 are both located on a rear side of the middle section 52, and the outer end of the first section 51 and the outer end of the second section 53 of the second heat exchange tube 502 are both located on the rear side of the middle section 52, that is, the first header 1, the second header 2, the third header 3, and the fourth header 4 are all located on the rear side of the middle section 51. It can be understood that the outer end of the first section 51 and the outer end of the second section 53 of the first heat exchange tube 501 may alternatively be both located on a front side of the middle section 52, and the outer end of the first section 51 and the outer end of the second section 53 of the second heat exchange tube 502 are also located on the front side of the middle section 52, that is, the first header 1, the second header 2, the third header 3, and the fourth header 4 are all located on the front side of the middle section 51. Arranging the first header 1, the second header 2, the third header 3, and the fourth header 4 on a same side of the middle section 51 can reduce a difference between inlet air temperature differences of multiple systems when the multiple systems operate at the same time, thereby facilitating a balance between the systems.

Further, the angle β1 of the first heat exchange tube 501 is different from the angle β1 of the second heat exchange tube 502, and/or the included angle β2 of the first heat exchange tube 501 is different from the angle β2 of the second heat exchange tube 502.

According to the heat exchanger 100 in this embodiment of this application, the outer end of the first section 51 of the first heat exchange tube 501 and the outer end of the first section 51 of the second heat exchange tube 502 are staggered, that is, the angle β1 of the first heat exchange tube 501 is different from the angle β1 of the second heat exchange tube 502, so that the first header 1 and the third header 3 can be installed on a same side of the width direction of the middle section 52. Similarly, the outer end of the second section 53 of the first heat exchange tube 501 and the outer end of the second section 53 of the second heat exchange tube 502 are staggered, that is, the angle β2 of the first heat exchange tube 501 is different from the angle β2 of the second heat exchange tube 502, so that the second header 2 and the fourth header 4 can be installed on a same side of the width direction of the middle section 52.

As shown in FIG. 11, the angle β1 of the first heat exchange tube 501 is the same as the angle β2 of the first heat exchange tube 501, and the angle β1 of the second heat exchange tube 502 is the same as the angle β2 of the second heat exchange tube 502. In addition, the angle β1 of the first heat exchange tube 501 and the angle β2 of the first heat exchange tube 501 are greater than the angle β1 of the second heat exchange tube 502 and the angle β2 of the second heat exchange tube 502, so that the third header 3 and the fourth header 4 are closer in the width direction of the middle section 52 to the middle section 52 than the first header 1 and the second header 2.

As shown in FIG. 12, the angle β1 of the first heat exchange tube 501 is greater than the angle β2 of the first heat exchange tube 501, and the angle β1 of the second heat exchange tube 502 is less than the angle β2 of the second heat exchange tube 502. In addition, the angle β1 of the first heat exchange tube 501 is the same as the angle β2 of the second heat exchange tube 501, and the angle β2 of the first heat exchange tube 501 is the same as the angle β1 of the second heat exchange tube 502, so that the third header 3 and the second header 2 are closer in the width direction of the middle section 52 to the middle section 52 than the first header 1 and the fourth header 4.

In some other specific embodiments, the first header 1 and the second header 2 are located on one side of the middle section 52 of the first heat exchange tube 501 in the width direction of the middle section 52 of the first heat exchange tube 501, and the third header 3 and the fourth header 4 are located on the other side of the middle section 52 of the first heat exchange tube 501 in the width direction of the middle section 52 of the first heat exchange tube 501.

Figure 7:
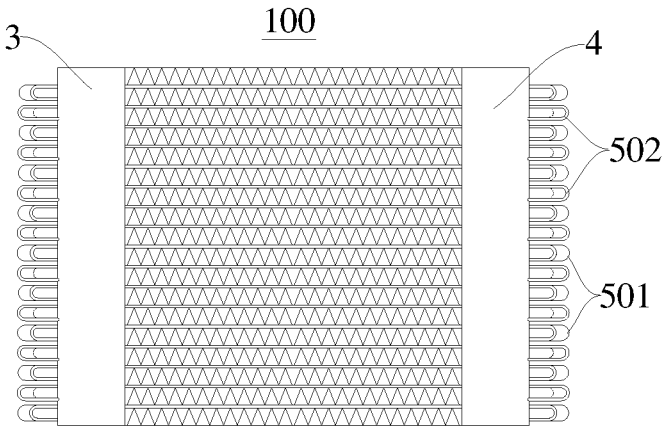
FIG. 7 is a top view of the heat exchanger in FIG. 6.
Figure 8:
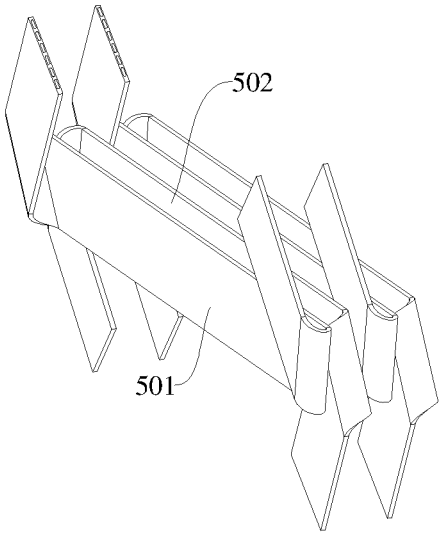
FIG. 8 is a schematic structural diagram of some of the heat exchange tubes in FIG. 6.

As shown in FIG. 6 to FIG. 8, the outer end of the first section 51 and the outer end of the second section 53 of the first heat exchange tube 501 are both located on a rear side of the middle section 52, and the outer end of the first section 51 and the outer end of the second section 53 of the second heat exchange tube 502 are both located on a front side of the middle section 52, that is, the first header 1 and the second header 2 are located on the rear side of the middle section 51, and the third header 3 and the fourth header 4 are located on the front side of the middle section 51. It can be understood that the outer end of the first section 51 and the outer end of the second section 53 of the first heat exchange tube 501 may alternatively be both located on the front side of the middle section 52, and the outer end of the first section 51 and the outer end of the second section 53 of the second heat exchange tube 502 are both located on the rear side of the middle section 52, that is, the first header 1 and the second header 2 are both located on the front side of the middle section 51, and the third header 3 and the fourth header 4 are located on the rear side of the middle section 51. Arranging the first header 1 and the second header 2 on the front side of the middle section 51 and the third header 3 and the fourth header 4 on the rear side of the middle section 51 can improve evenness of outlet air temperatures when the systems operate separately.

Further, the angle β1 of the first heat exchange tube 501 is the same as the angle β1 of the second heat exchange tube 502, and/or the angle β2 of the first heat exchange tube 501 is the same as the angle β2 of the second heat exchange tube 502.

Furthermore, the angle β1 of the first heat exchange tube 501 is the same as the angle β2 of the first heat exchange tube 501, and the angle β1 of the second heat exchange tube 502 is the same as the angle β2 of the second heat exchange tube 502. In addition, the angle β1 of the first heat exchange tube 501 and the angle β2 of the first heat exchange tube 501 are the same as the angle β1 of the second heat exchange tube 502 and the angle β2 of the second heat exchange tube 502.

In some embodiments, the first heat exchange tube 501 has a bent section, a first section 51, a middle section 52, and a second section 53. In other words, a plurality of first heat exchange tubes 501 are bent tubes. The first header 1 and the second header 2 are located on different sides of the middle section 52 of the first heat exchange tube 501 in a width direction of the middle section 52 of the first heat exchange tube 501.

In other words, an outer end of the first section 51 (an end, away from the middle section 52, of the first section 51) and an outer end of the second section 53 (an end, away from the middle section 52, of the second section 53) of the first heat exchange tube 501 are located on different sides of the width direction of the middle section 52.

Figure 4:
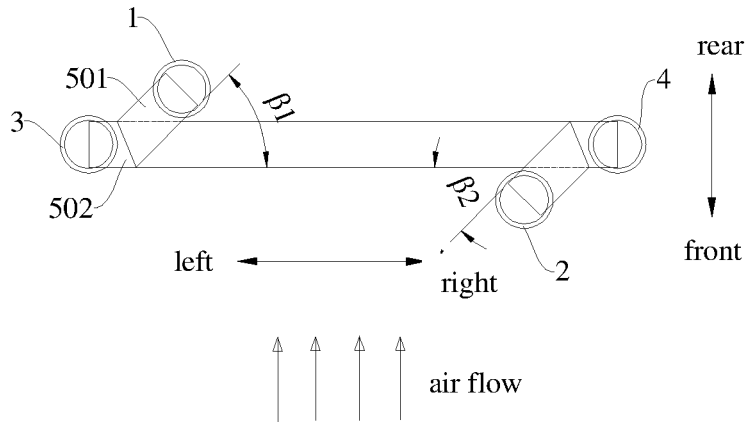
FIG. 4 is a main view of a heat exchanger according to another embodiment of this application.
Figure 5:
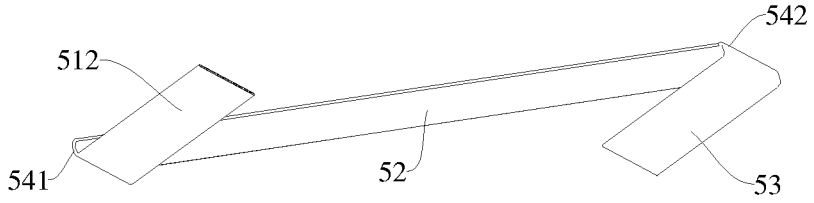
FIG. 5 is a schematic structural diagram of the heat exchange tube in FIG. 4.
Figure 9:
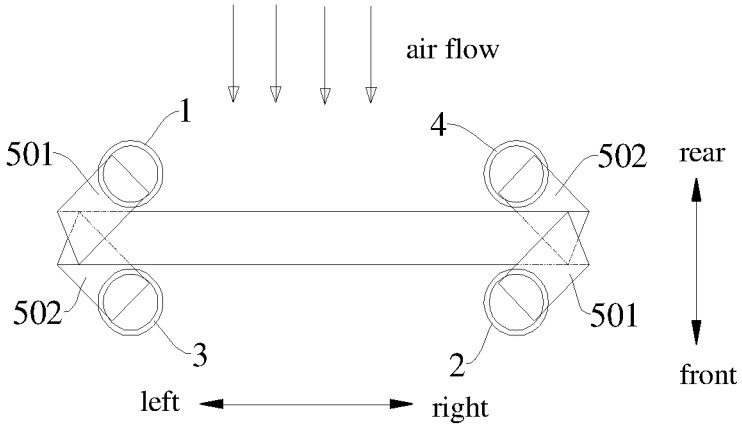
FIG. 9 is a main view of a heat exchanger according to yet another embodiment of this application.
Figure 10:
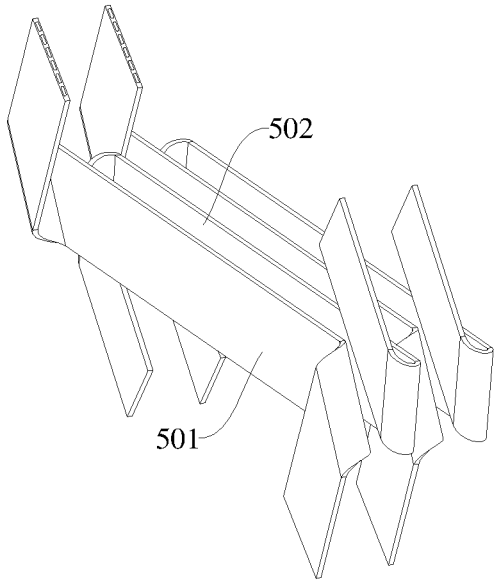
FIG. 10 is a schematic structural diagram of some of the heat exchange tubes in FIG. 9.

As shown in FIG. 4, FIG. 5, and FIG. 9, the outer end of the first section 51 of the first heat exchange tube 501 is located on a rear side of the middle section 52, and the outer end of the second section 53 is located on a front side of the middle section 52, that is, the first header 1 is located on the rear side of the middle section 52, and the second header 2 is located on the front side of the middle section 52. It can be understood that, alternatively the outer end of the first section 51 of the first heat exchange tube 501 is located on the front side of the middle section 52, and the outer end of the second section 53 is located on the rear side of the middle section 52, that is, the first header 1 is located on the front side of the middle section 52, and the second header 2 is located on the rear side of the middle section 52. The first header 1 is arranged on the rear side of the middle section 52 and the second header 2 is arranged on the front side of the middle section 52, or the first header 1 is arranged on the front side of the middle section 52 and the second header 2 is arranged on the rear side of the middle section 52, so that an air flow direction can be designed for operating of a single system and a flow direction of refrigerant can be designed to be upstream or downstream, so as to improve a heat exchange effect.

In some specific embodiments, the second heat exchange tube 502 has a bent section, a first section 51, a middle section 52, and a second section 53. In other words, a plurality of second heat exchange tubes 502 are also bent tubes. The third header 3 and the fourth header 4 are located on different sides of the middle section 52 of the second heat exchange tube 502 in a width direction of the middle section 52 of the second heat exchange tube 502.

In other words, an outer end of the first section 51 (an end, away from the middle section 52, of the first section 51) and an outer end of the second section 53 (an end, away from the middle section 52, of the second section 53) of the second heat exchange tube 502 are located on different sides of the width direction of the middle section 52.

As shown in FIG. 9, the outer end of the first section 51 of the second heat exchange tube 502 is located on a front side of the middle section 52, and the outer end of the second section 53 is located on a rear side of the middle section 52, that is, the third header 3 is located on the front side of the middle section 52, and the fourth header 4 is located on the rear side of the middle section 52. It can be understood that, alternatively the outer end of the first section 51 of the second heat exchange tube 502 is located on the rear side of the middle section 52, and the outer end of the second section 53 is located on the front side of the middle section 52, that is, the third header 3 is located on the rear side of the middle section 52, and the fourth header 4 is located on the front side of the middle section 52.

In some specific embodiments, the first header 1 and the fourth header 4 are located on a same side of the middle section 51 of the first heat exchange tube 501 in the width direction of the middle section of the first heat exchange tube 501, and the second header 2 and the third header 3 are located on a same side of the middle section 51 of the first heat exchange tube 501 in the width direction of the middle section 51 of the first heat exchange tube 501.

As shown in FIG. 9, the outer end of the first section 51 of the first heat exchange tube 501 is located on the rear side of the middle section 52, and the outer end of the second section 53 of the second heat exchange tube 502 is located on the rear side of the middle section 52, that is, the first header 1 and the fourth header 4 are both located on the rear side of the middle section 51. The outer end of the second section 53 of the first heat exchange tube 501 is located on the front side of the middle section 52, and the outer end of the first section 51 of the second heat exchange tube 502 is located on the front side of the middle section 52, that is, the second header 2 and the third header 3 are both located on the front side of the middle section 52. Arranging the first header 1 and the fourth header 4 on the rear side of the middle section 51 and the second header 2 and the third header 3 on the front side of the middle section 51, or arranging the first header 1 and the fourth header 4 on the front side of the middle section 51 and the second header 2 and the third header 3 on the rear side of the middle section 51 facilitates performance balancing between dual systems when the dual systems operate at the same time.

Figure 15:
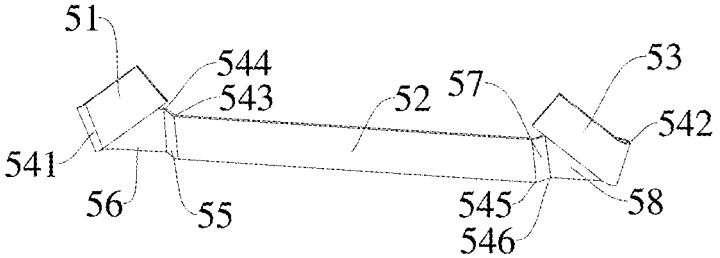
FIG. 15 is a schematic structural diagram of the heat exchange tube in FIG. 13.
Figure 16:
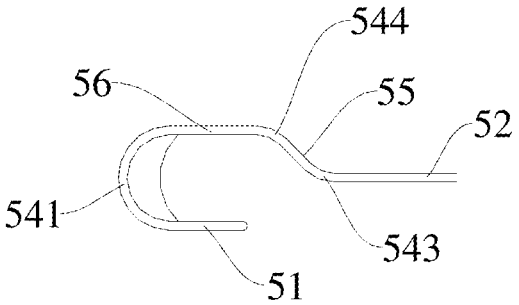
FIG. 16 is a schematic structural diagram of a part of the heat exchange tube in FIG. 13.

In some embodiments, as shown in FIG. 15 and FIG. 16, the middle section 52 includes a first end (a left end of a middle section 52 shown in FIG. 15) and a second end (a right end of a middle section 52 shown in FIG. 15) that are opposite to each other in the length direction of the middle section 52, the first heat exchange tube 501 further includes a third section 55, a fourth section 56, a fifth section 57, and a sixth section 58, and the bent section 54 further includes a third bent section 543, a fourth bent section 544, a fifth bent section 545, and a sixth bent section 546.

The first end of the middle section 52 and the third section 55 are connected through the third bent section 543, the third section 55 and the fourth section 56 are connected through the fourth bent section 544, and the fourth section 56 and the first section 51 are connected through the first bent section 541. In addition, a first longitudinal side face of the fourth section 56 is parallel to a first longitudinal side face of the middle section 52, and a first longitudinal side face of the third section is inclined to the first longitudinal side face 521 of the middle section 52.

As shown in FIG. 15 and FIG. 16, the left end of the middle section 52 is connected to the third bent section 543, a right end of the third section 55 is connected to the third bent section 543, a left end of the third section 55 is connected to the fourth bent section 544, a right end of the fourth section 56 is connected to the fourth bent section 544, and a left end of the fourth section 56 is connected to the first bent section 541. The third section 55 is inclined toward the front side relative to the middle section 52 to space apart the fourth section 56 and the middle section 52 in the front-to-rear direction, and the fourth section 56 and the middle section 52 are arranged in parallel.

The second end of the middle section 52 is connected to the fifth section 57 through the fifth bent section 545, the fifth section 57 is connected to the sixth section 58 through the sixth bent section 546, and the sixth section 58 is connected to the second section 53 through the second bent section 542. In addition, a first longitudinal side face of the sixth section 58 is parallel to the first longitudinal side face of the middle section 52, and a first longitudinal side face of the fifth section is inclined to the first longitudinal side face of the middle section 52.

As shown in FIG. 15, a right end of the middle section 52 is connected to the fifth bent section 545, a left end of the fifth section 57 is connected to the fifth bent section 545, a right end of the fifth section 57 is connected to the sixth bent section 546, a left end of the sixth section 58 is connected to the sixth bent section 546, and a right end of the sixth section 58 is connected to the second bent section 542. The fifth section 57 is inclined toward the front side relative to the middle section 52 to space apart the sixth section 58 and the middle section 52 in the front-to-rear direction, and the sixth section 58 and the middle section 52 are arranged in parallel.

Further, the fourth section 56 and the sixth section 58 are aligned in the left-right direction.

In the embodiment shown in FIG. 15 and FIG. 16, arrangement of a plurality of bent sections can further reduce stress concentration, and improve reliability of the heat exchanger.

Figure 17:
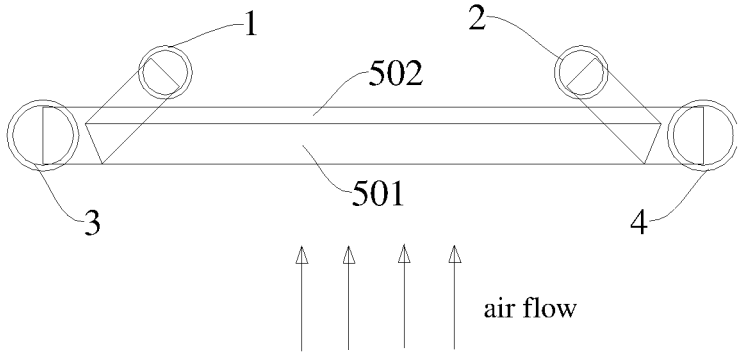
FIG. 17 is a main view of a heat exchanger according to a yet further embodiment of this application.
Figure 18:
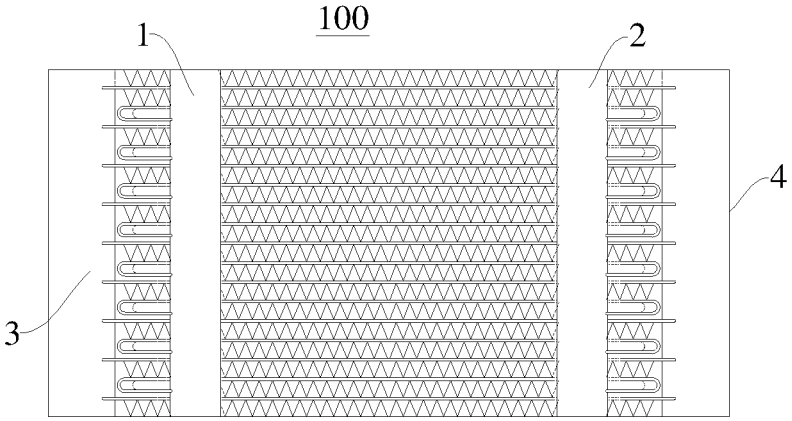
FIG. 18 is a top view of the heat exchanger in FIG. 17.

In some embodiments, a width of the first heat exchange tube 501 is different from a width of the second heat exchange tube 502. As shown in FIG. 17, the width of first heat exchange tube 501 is less than the width of the second heat exchange tube 502.

Further, the first heat exchange tube 501 is a bent tube, and the second heat exchange tube 502 is a straight tube. It can be understood that the width of the bent tube is less than that of the straight tube, that is, the bent heat exchange tube uses a smaller-width heat exchange tube, which helps implement bending of the heat exchange tube and improve reliability of the heat exchanger, and meanwhile can adapt to a heat exchange volume difference between the first system and the second system to achieve differentiated matching of different systems.

In some specific embodiments, a length, in a width direction of the second heat exchange tube 502, of the fin 6 between the first heat exchange tube 501 and the second heat exchange tube 502 is greater than or equal the width of the second heat exchange tube 502.

Figure 23:
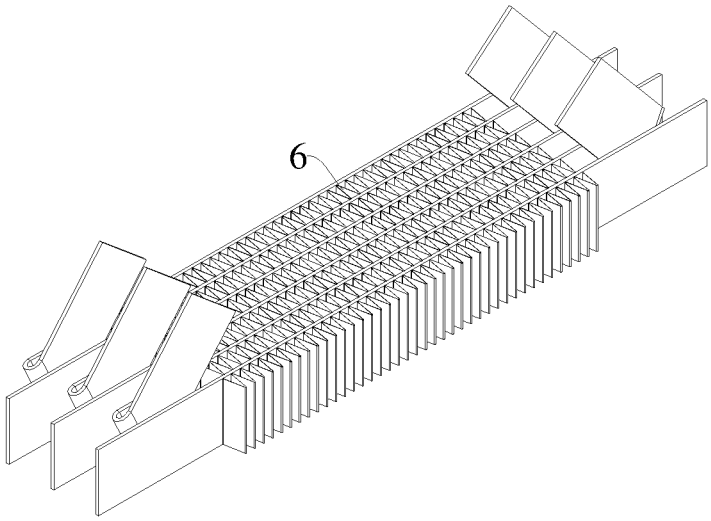
FIG. 23 is a schematic structural diagram of some heat exchange tubes according to an embodiment of this application, showing an example structure of fins.
Figure 24:
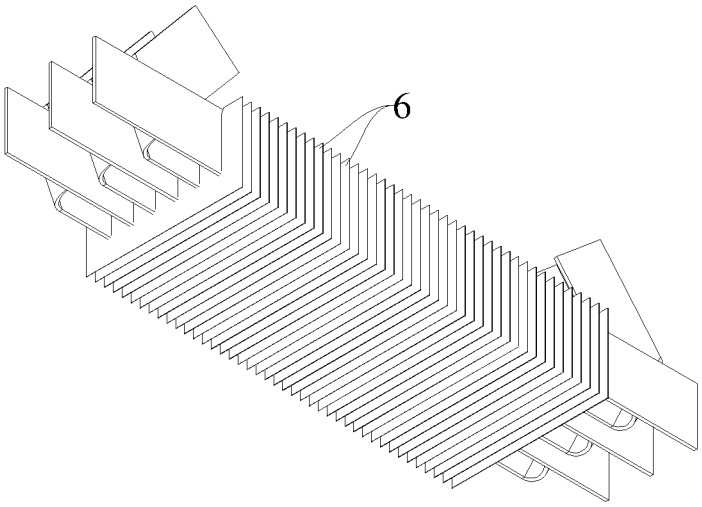
FIG. 24 is a schematic structural diagram of some heat exchange tubes according to an embodiment of this application, showing another example structure of fins.

It can be understood that the fins 6 between the first heat exchange tube 501 and the second heat exchange tube 502 may be wave-shaped fins. As shown in FIG. 23, the wave-shaped fins extend in the length direction of the middle section 51 of the heat exchange tube 5. Alternatively, the fins 6 may be forked fins, as shown in FIG. 24, or other types of fins.

In some embodiments, the first section 51 or the second section 53 or both of at least one of the first heat exchange tube 501 and the second heat exchange tube 502 are twisted to form a twisted section 59. The first section 51 is twisted around the length direction of the first section 51 to form a first twisted section 591, and the second section 53 is twisted around the length direction of the second section 53 to form a second twisted section 592.

Figure 19:
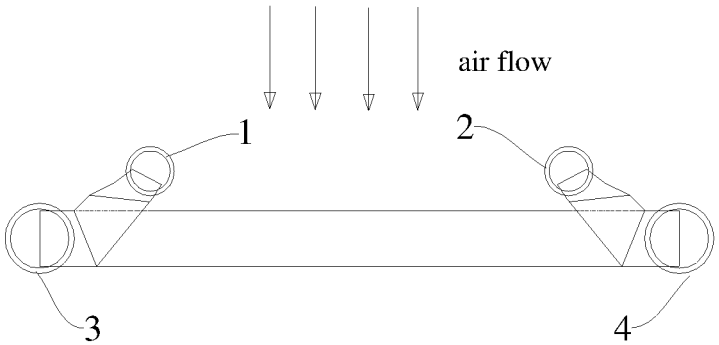
FIG. 19 is a main view of a heat exchanger according to a still yet further embodiment of this application.
Figure 20:
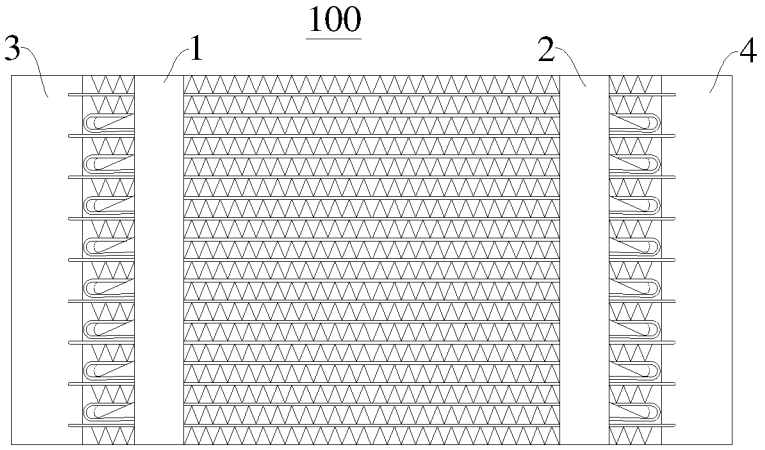
FIG. 20 is a top view of the heat exchanger in FIG. 19.

As shown in FIG. 19 and FIG. 20, the first heat exchange tube 501 is a bent tube, the second heat exchange tube 502 is a straight tube, the first section 51 of the first heat exchange tube 501 is twisted to form a first twisted section 591, and the second section 53 of the first heat exchange tube 501 is twisted to form a second twisted section 592.

Figure 21:
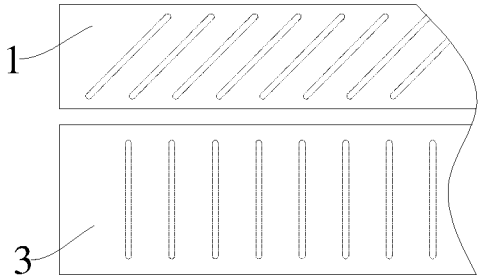
FIG. 21 is a schematic diagram of a header in FIG. 19.

Further, as shown in FIG. 21, a diameter of the first header 1 is the same as a diameter of the second header 2, a diameter of the third header 3 is the same as a diameter of the fourth header 4, and the diameters of the first header 1 and the second header 2 are less than the diameters of the third header 3 and the fourth header 4. In this way, diameters of some headers can be reduced, and reducing a diameter of a header helps increase an effective heat exchange area.

An air conditioning unit with multiple refrigeration systems according to an embodiment of this application is described below with reference to FIG. 22 of the accompanying drawings.

The air conditioning unit 200 with multiple refrigeration systems according to this embodiment of this application includes multiple refrigeration systems. The multiple refrigeration systems include a first refrigeration system and a second refrigeration system, and the first refrigeration system and the second refrigeration system share at least one heat exchanger. The heat exchanger is an evaporator and/or a condenser of the first refrigeration system and the second refrigeration system, and the heat exchanger is the heat exchanger 100 according to any one of the foregoing embodiments.

More specifically, the multiple refrigeration systems include a plurality of compressors 210, a condenser 220, a plurality of throttling apparatuses 230, and an evaporator 240, where at least two refrigeration systems share one condenser 220 or one evaporator 240.

The following uses an air conditioning unit with dual refrigeration systems as an example for description, but this application is not limited thereto.

Figure 22:
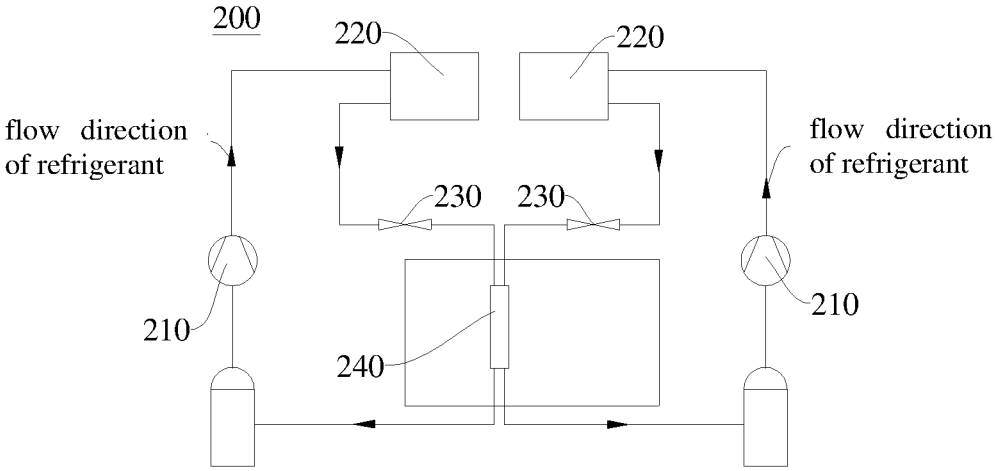
FIG. 22 is a schematic diagram of an air conditioning unit with multiple refrigeration systems according to an embodiment of this application.

As shown in FIG. 22, an air conditioning unit 2 with dual refrigeration systems includes two compressor 210, two condenser 220, two throttling apparatuses 230, and an evaporator 240. In other words, the two refrigeration systems are respectively a first refrigeration system and a second refrigeration system, and share one evaporator 240. The evaporator 240 is the heat exchanger 1 according to the embodiment of this application, and the throttling apparatus 230 may be an expansion valve.

The first refrigeration system includes one compressor 210, one condenser 220, and one expansion valve. The compressor 210, the condenser 220, and the expansion valve are connected in series in sequence, and the expansion valve and the compressor 210 are respectively connected to a first header 1 and a second header 2 of the evaporator 240 (the heat exchanger 100).

The second refrigeration system includes another compressor 210, another condenser 220, and another expansion valve. The compressor 210, the condenser 220, and the expansion valve are connected in series in sequence, and the expansion valve and the compressor 210 are respectively connected to a third header 3 and a fourth header 4 of the evaporator 240 (the heat exchanger 100).

In other words, the first header 1 and the second header 2 are respectively connected to pipes of the first refrigeration system, and the third header 3 and the fourth header 4 are respectively connected to pipes of the second refrigeration system.

In this air conditioning unit with dual refrigeration systems, depending on load requirements, one of the refrigeration systems can be selected for separate operating (partial load operation) or two of the refrigeration systems can be selected for operating at the same time (full load operation).

In some embodiments, the air conditioning unit 200 with multiple refrigeration systems includes refrigerant, a flow direction of the refrigerant in the first section 51 is opposite to a flow direction of the refrigerant in the middle section 52, and a flow direction of the refrigerant in the second section 53 is opposite to the flow direction of the refrigerant in the middle section 52.

In other words, when the refrigerant flows from the first section 51 to the middle section 52 or from the middle section 52 to the first section 51, a direction reversal occurs in the first bent section 541, and when the refrigerant flows from the second section 53 to the middle section 52 or from the middle section 52 to the second section 53, a direction reversal occurs in the second bent section 544.

In some embodiments, a first heat exchange tube 501 or a second heat exchange tube 502 or both in the evaporator 240 include a bent section 54, a first section 51, a middle section 52, and a second section 53. That the first heat exchange tube 501 includes a bent section 54, a first section 51, a middle section 52, and a second section 53 is used as an example. An outer end of the first section 51 of the first heat exchange tube 501 is connected to the first header 1, and an outer end of the second section 53 of the first heat exchange tube 501 is connected to the second header 2.

In the first heat exchange tube 501 shown in FIG. 1, the refrigerant enters the first section 51 from the outer end of the first section 51 and flows in a leftward forward direction until it reaches the first bent section 541, and at the first bent section 541, a direction reversal occurs so that the refrigerant flows in a left-to-right direction until it reaches the second bent section 542. At the second bent section 542, a direction reversal occurs so that the refrigerant flows in a leftward backward direction. Reversal of a flow direction of the refrigerant in the system increases a local pressure drop for refrigerant flow, which facilitates distribution of the refrigerant into headers.

In some embodiments, the heat exchanger 100 uses the heat exchanger shown in FIG. 6 to FIG. 8, an outer end of the first section 51 of the second heat exchange tube 502 is connected to the third header 3, and an outer end of the second section 53 of the second heat exchange tube 502 is connected to the fourth header 4.

In other words, the first heat exchange tube 501 and the second heat exchange tube 502 are both bent tubes, the first header 1 and the second header 2 are located on one side of the middle section 52 of the first heat exchange tube 501 in a width direction of the middle section 52 of the first heat exchange tube 501, and the third header 3 and the fourth header 4 are located on the other side of the middle section 52 of the first heat exchange tube 501 in the width direction of the middle section 52 of the first heat exchange tube 501. As shown in FIG. 6 to FIG. 8, the outer end of the first section 51 and the outer end of the second section 53 of the first heat exchange tube 501 are both located on a rear side of the middle section 52, and the outer end of the first section 51 and the outer end of the second section 53 of the second heat exchange tube 502 are both located on a front side of the middle section 52, that is, the first header 1 and the second header 2 are located on the rear side of the middle section 51, and the third header 3 and the fourth header 4 are located on the front side of the middle section 51.

A flow direction of the refrigerant in the first heat exchange tube 501 is the same as that of the refrigerant in the second heat exchange tube 502. In other words, the first header 1 is used as an inlet of the first system, the third header 3 is used as an inlet of the second system, and the first header 1 and the third header 3 are located on a same side of the middle section 52 of the first heat exchange tube 501 in a length direction of the middle section 52 the first heat exchange tube 501.

As shown in FIG. 6 to FIG. 8, the first header 1 and the third header 3 are located on a left side of the middle section 51, refrigerant of the first system enters the first heat exchange tube 501 through the first header 1, and enters the second header 2 through the first heat exchange tube 501, that is, the refrigerant of the first system flows into the first header 1 and flows out from the second header 2. Refrigerant of the second system enters the second heat exchange tube 502 through the third header 3, and enters the fourth header 4 through the second heat exchange tube 502, that is, the refrigerant of the second system flows into the third header 3 and flows out from the fourth header 4.

In the description of this specification, descriptions with reference to the term such as "an embodiment", "some embodiments", "example", "specific example", or "some examples" mean that specific features, structures, materials, or characteristics described with reference to the embodiment or example are included in at least one embodiment or example of this application. In this specification, illustrative descriptions of the foregoing terms do not necessarily refer to a same embodiment or example. Moreover, the described specific features, structures, materials, or characteristics can be combined in any one or more embodiments or examples in an appropriate manner. In addition, those skilled in the art can combine different embodiments or examples described in the specification and features of the different embodiments or examples without contradicting each other.

In the description of this specification, "a plurality of" means at least two, such as two or three, unless otherwise specifically defined.

Although the embodiments of this application are shown and described above, it can be understood that the foregoing embodiments are examples and shall not be construed as a limitation on this application. A person of ordinary skill in the art may make changes, modifications, substitutions, and variants based on the foregoing embodiments within the scope of this application.

What is claimed is:

1. A heat exchanger, comprising:

a first header and a second header, wherein the first header and the second header are arranged in parallel;

a third header and a fourth header, wherein the third header and the fourth header are arranged in parallel, the third header and the first header are arranged in parallel, and the fourth header and the second header are arranged in parallel;

a heat exchange tube, wherein the heat exchange tube comprises a plurality of first heat exchange tubes arranged in parallel and a plurality of second heat exchange tubes arranged in parallel, the first heat exchange tube and the second heat exchange tube are arranged in parallel, the first heat exchange tubes and the second heat exchange tubes are alternately arranged in a length direction of the first header, one end of the first heat exchange tube is connected to the first header, the other end of the first heat exchange tube is connected to the second header to connect the first header and the second header, one end of the second heat exchange tube is connected to the third header, and the other end of the second heat exchange tube is connected to the fourth header to connect the third header and the fourth header; and fins, wherein the fins are arranged between adjacent heat exchange tubes, and at least two of the fins are arranged between the first heat exchange tube and the second heat exchange tube that are adjacent in the length direction of the first header, wherein at least one of the first heat exchange tube and the second heat exchange tube has a bent section and comprises a first section, a middle section, and a second section, the bent section comprises a first bent section and a second bent section, the first section and the middle section are connected through the first bent section, and the second section and the middle section are connected through the second bent section;

the first section comprises a first longitudinal side face and a second longitudinal side face which are arranged opposite to each other in a thickness direction of the first section, the middle section comprises a first longitudinal side face and a second longitudinal side face which are arranged opposite to each other in a thickness direction of the middle section, the first longitudinal side face of the first section and the first longitudinal side face of the middle section are arranged in parallel, the second longitudinal side face of the first section in a thickness direction of the middle section is between the first longitudinal side face of the first section and the first longitudinal side face of the middle section; and the heat exchanger comprises a first part, a middle part, and a second part, the middle part of the heat exchanger comprises the middle section and the fins, the first part of the heat exchanger comprises the first section, between the middle section and at least a part of the first section form an acute angle, and air flowing through the heat exchanger passes through the middle part of the heat exchanger and then the first part of the heat exchanger, or passes through the first part of the heat exchanger and then the middle part of the heat exchanger.

2. The heat exchanger according to claim 1, wherein the second part of the heat exchanger comprises the second section, the second section comprises a first longitudinal side face and a second longitudinal side face which are arranged opposite to each other in a thickness direction of the second section, the first longitudinal side face of the second section and the first longitudinal side face of the middle section are arranged in parallel, the second longitudinal side face of the second section in a thickness direction of the middle section is between the first longitudinal side face of the second section and the first longitudinal side face of the middle section;

between the middle section and at least a part of the second section form an acute angle, and air flowing through the heat exchanger passes through the middle part of the heat exchanger and then the second part of the heat exchanger, or passes through the second part of the heat exchanger and then the middle part of the heat exchanger, and passes through the first part of the heat exchanger and the second part of the heat exchanger in parallel.

3. The heat exchanger according to claim 1, wherein the first heat exchange tube has the bent section, the first section, the middle section, and the second section, one end of the first section of the first heat exchange tube is connected to the first header, and the other end of the first section of the first heat exchange tube is connected to the first bent section; and one end of the second section of the first heat exchange tube is connected to the second header, and the other end of the second section of the first heat exchange tube is connected to the second bent section.

4. The heat exchanger according to claim 3, wherein the first header and the second header are located on a same side of the middle section of the first heat exchange tube in a width direction of the middle section of the first heat exchange tube; or the first header and the second header are located on different sides of the middle section of the first heat exchange tube in a width direction of the middle section of the first heat exchange tube.

5. The heat exchanger according to claim 3, wherein the second heat exchange tube has the bent section, the first section, the middle section, and the second section, one end of the first section of the second heat exchange tube is connected to the third header, and the other end of the first section of the second heat exchange tube is connected to the first bent section; and one end of the second section of the second heat exchange tube is connected to the fourth header, and the other end of the second section of the second heat exchange tube is connected to the second bent section.

6. The heat exchanger according to claim 5, wherein the third header and the fourth header are located on a same side of the middle section of the second heat exchange tube in a width direction of the middle section of the second heat exchange tube.

7. The heat exchanger according to claim 1, wherein the third header and the fourth header are located on different sides of the middle section of the second heat exchange tube in a width direction of the middle section of the second heat exchange tube;

wherein the first header and the fourth header are located on a same side of the middle section of the first heat exchange tube in the width direction of the middle section of the first heat exchange tube and the second header and the third header are located on a same side of the middle section of the first heat exchange tube in the width direction of the middle section of the first heat exchange tube.

8. The heat exchanger according to claim 1, wherein the middle section comprises a first end and a second end arranged opposite to each other in a length direction of the middle section, at least one of the first heat exchange tube and the second heat exchange tube further comprises a third section, a fourth section, a fifth section, and a sixth section, the bent section further comprises a third bent section, a fourth bent section, a fifth bent section, and sixth bent section, the first end of the middle section and the third section are connected through the third bent section, the third section and the fourth section are connected through the fourth bent section, the fourth section and the first section are connected through the first bent section, the fourth section is parallel to the middle section, and the third section is inclined to the middle section; and the second end of the middle section and the fifth section are connected through the fifth bent section, the fifth section and the sixth section are connected through the sixth bent section, the sixth section and the second section are connected through the second bent section, the sixth section is parallel to the middle section, and the fifth section is inclined to the middle section.

9. The heat exchanger according to claim 1, wherein a width of the first heat exchange tube is less than a width of the second heat exchange tube; and wherein a length, in a width direction of the second heat exchange tube, of the fin between the first heat exchange tube and the second heat exchange tube is greater than or equal to the width of the second heat exchange tube.

10. An air conditioning unit with multiple refrigeration systems, comprising a first refrigeration system and a second refrigeration system, wherein the first refrigeration system and the second refrigeration system share at least one heat exchanger, wherein the heat exchanger comprises:

a first header and a second header, wherein the first header and the second header are arranged in parallel;

a third header and a fourth header, wherein the third header and the fourth header are arranged in parallel, the third header and the first header are arranged in parallel, and the fourth header and the second header are arranged in parallel;

a heat exchange tube, wherein the heat exchange tube comprises a plurality of first heat exchange tubes arranged in parallel and a plurality of second heat exchange tubes arranged in parallel, the first heat exchange tube and the second heat exchange tube are arranged in parallel, the first heat exchange tubes and the second heat exchange tubes are alternately arranged in a length direction of the first header, one end of the first heat exchange tube is connected to the first header, the other end of the first heat exchange tube is connected to the second header to connect the first header and the second header, one end of the second heat exchange tube is connected to the third header, and the other end of the second heat exchange tube is connected to the fourth header to connect the third header and the fourth header; and fins, wherein the fins are arranged between adjacent heat exchange tubes, and at least two of the fins are arranged between the first heat exchange tube and the second heat exchange tube that are adjacent in the length direction of the first header, wherein at least one of the first heat exchange tube and the second heat exchange tube has a bent section and comprises a first section, a middle section, and a second section, the bent section comprises a first bent section and a second bent section, the first section and the middle section are connected through the first bent section, and the second section and the middle section are connected through the second bent section;

the first section comprises a first longitudinal side face and a second longitudinal side face that are arranged opposite to each other in a thickness direction of the first section, the middle section comprises a first longitudinal side face and a second longitudinal side face that are arranged opposite to each other in a thickness direction of the middle section, the first longitudinal side face of the first section and the first longitudinal side face of the middle section are arranged in parallel, the second longitudinal side face of the first section in a thickness direction of the middle section is between the first longitudinal side face of the first section and the first longitudinal side face of the middle section; and the heat exchanger comprises a first part, a middle part, and a second part, the middle part of the heat exchanger comprises the middle section and the fins, the first part of the heat exchanger comprises the first section, between the middle section and at least a part of the first section form an acute angle, and air flowing through the heat exchanger passes through the middle part of the heat exchanger and then the first part of the heat exchanger, or passes through the first part of the heat exchanger and then the middle part of the heat exchanger;

wherein the first header and the second header are respectively connected to pipes of the first refrigeration system, and the third header and the fourth header are respectively connected to pipes of the second refrigeration system.

11. The air conditioning unit with multiple refrigeration systems according to claim 10, wherein the air conditioning unit with multiple refrigeration systems comprises refrigerant, a flow direction of the refrigerant in the first section is opposite to a flow direction of the refrigerant in the middle section, and a flow direction of the refrigerant in the second section is opposite to the flow direction of the refrigerant in the middle section.

12. A heat exchanger, comprising:

a first header and a second header, wherein the first header and the second header are arranged in parallel;

a third header and a fourth header, wherein the third header and the fourth header are arranged in parallel, the third header and the first header are arranged in parallel, and the fourth header and the second header are arranged in parallel;

a heat exchange tube, wherein the heat exchange tube comprises a plurality of first heat exchange tubes arranged in parallel and a plurality of second heat exchange tubes arranged in parallel, the first heat exchange tube and the second heat exchange tube are arranged in parallel, the first heat exchange tubes and the second heat exchange tubes are alternately arranged in a length direction of the first header, one end of the first heat exchange tube is connected to the first header, the other end of the first heat exchange tube is connected to the second header to connect the first header and the second header, one end of the second heat exchange tube is connected to the third header, and the other end of the second heat exchange tube is connected to the fourth header to connect the third header and the fourth header; and fins, wherein the fins are arranged between adjacent heat exchange tubes, and at least two of the fins are arranged between the first heat exchange tube and the second heat exchange tube that are adjacent in the length direction of the first header, wherein the heat exchange tube comprises a first longitudinal side face and a second longitudinal side face parallel to a length direction of the heat exchange tube, and the first longitudinal side face and the second longitudinal side face are arranged opposite to each other in a thickness direction of the heat exchange tube; at least one of the first heat exchange tube and the second heat exchange tube has a bent section and comprises a first section, a middle section, and a second section; the bent section comprises a first bent section and a second bent section, the first section and the middle section are connected through the first bent section, and the second section and the middle section are connected through the second bent section; the first longitudinal side face of the first section and the first longitudinal side face of the middle section are arranged in parallel, and the first longitudinal side face of the second section and the first longitudinal side face of the middle section are arranged in parallel, the second longitudinal side face of the first section in a thickness direction of the middle section is between the first longitudinal side face of the first section and the first longitudinal side face of the middle section; the first longitudinal side face of the first section has a first side edge extending in a length direction of the first section, the first longitudinal side face of the middle section has a middle side edge extending in a length of the middle section, and the first longitudinal side face of the second section has a second side edge extending in a length of the second section; an angle $\beta 1$ formed between the first side edge and the middle side edge is an acute angle, and an angle $\beta 2$ formed between the second side edge and the middle side edge is an acute angle.

13. The heat exchanger according to claim 12, wherein the first heat exchange tube has the bent section, the first section, the middle section, and the second section, one end of the first section of the first heat exchange tube is connected to the first header, and the other end of the first section of the first heat exchange tube is connected to the first bent section; and one end of the second section of the first heat exchange tube is connected to the second header, and the other end of the second section of the first heat exchange tube is connected to the second bent section.

14. The heat exchanger according to claim 12 wherein the first heat exchange tube has the bent section, the first section, the middle section, and the second section, and the first header and the second header are located on a same side of the middle section of the first heat exchange tube in a width direction of the middle section of the first heat exchange tube; and wherein the second heat exchange tube has the bent section, the first section, the middle section, and the second section, and the third header and the fourth header are located on a same side of the middle section of the second heat exchange tube in a width direction of the middle section of the second heat exchange tube.

15. The heat exchanger according to claim 14, wherein the first header, the second header, the third header, and the fourth header are located on a same side of the first heat exchange tube in the width direction of the middle section of the first heat exchange tube.

16. The heat exchanger according to claim 15, wherein the angle β1 of the first heat exchange tube is different from the angle β1 of the second heat exchange tube, or the angle β2 of the first heat exchange tube is different from the angle β2 of the second heat exchange tube;

or the angle β1 of the first heat exchange tube is different from the angle β1 of the second heat exchange tube and the angle β2 of the first heat exchange tube is different from the angle β2 of the second heat exchange tube.

17. The heat exchanger according to claim 12, wherein the first header and the second header are located on one side of the middle section of the first heat exchange tube in the width direction of the middle section of the first heat exchange tube, and the third header and the fourth header are located on the other side of the middle section of the first heat exchange tube in the width direction of the middle section of the first heat exchange tube.

18. The heat exchanger according to claim 12, wherein the angle β1 of the first heat exchange tube is the same as the angle β1 of the second heat exchange tube, or the angle β2 of the first heat exchange tube is the same as the angle β2 of the second heat exchange tube; or the angle β1 of the first heat exchange tube is the same as the angle β1 of the second heat exchange tube, and the angle β2 of the first heat exchange tube is the same as the angle β2 of the second heat exchange tube.

19. The heat exchanger according to claim 12, wherein the middle section comprises a first end and a second end arranged opposite to each other in a length direction of the middle section, the first heat exchange tube further comprises a third section, a fourth section, a fifth section, and a sixth section, the bent section further comprises a third bent section, a fourth bent section, a fifth bent section, and sixth bent section, the first end of the middle section and the third section are connected through the third bent section, the third section and the fourth section are connected through the fourth bent section, the fourth section and the first section are connected through the first bent section, a first longitudinal side face of the fourth section is parallel to a first longitudinal side face of the middle section, and a first longitudinal side face of the third section is inclined to the first longitudinal side face of the middle section; and the second end of the middle section and the fifth section are connected through the fifth bent section, the fifth section and the sixth section are connected through the sixth bent section, the sixth section and the second section are connected through the second bent section, a first longitudinal side face of the sixth section is parallel to the first longitudinal side face of the middle section, and a first longitudinal side face of the fifth section is inclined to the first longitudinal side face of the middle section.

20. The heat exchanger according to claim 12 wherein the first heat exchange tube has the bent section, the first section, the middle section, and the second section, and the first header and the second header are located on different sides of the middle section of the first heat exchange tube in a width direction of the middle section of the first heat exchange tube; and wherein the second heat exchange tube has the bent section, the first section, the middle section, and the second section, and the third header and the fourth header are located on different sides of the middle section of the second heat exchange tube in a width direction of the middle section of the second heat exchange tube.

* * * * *